US007226395B2

(12) United States Patent
Wu et al.

(10) Patent No.: US 7,226,395 B2
(45) Date of Patent: Jun. 5, 2007

(54) VIRTUAL REALITY BICYCLE-TRAINING SIMULATION PLATFORM

(75) Inventors: Hung-Sheng Wu, Tuku Township, Yunlin County (TW); Chung-Chieh Chen, Taichung (TW); Tzu-Peng Chiang, Yongjing Township, Changhua County (TW)

(73) Assignee: Cycling & Health Tech Industry R & D Center, Taichung (TW)

( * ) Notice: Subject to any disclaimer, the term of this patent is extended or adjusted under 35 U.S.C. 154(b) by 137 days.

(21) Appl. No.: 11/177,806

(22) Filed: Jul. 8, 2005

(65) Prior Publication Data

US 2007/0010377 A1 Jan. 11, 2007

(51) Int. Cl.
*A63B 22/06* (2006.01)

(52) U.S. Cl. ..... 482/57; 482/61; 280/293

(58) Field of Classification Search ..... 482/4–9, 482/51, 57–65; 434/61; 280/293; 211/22
See application file for complete search history.

(56) References Cited

U.S. PATENT DOCUMENTS

| | | | | | |
|---|---|---|---|---|---|
| 3,903,613 | A * | 9/1975 | Bisberg | 434/61 |
| 4,595,194 | A * | 6/1986 | Previtali | 482/61 |
| 4,955,600 | A * | 9/1990 | Hoffenberg et al. | 482/61 |
| 5,050,865 | A * | 9/1991 | Augspurger et al. | 482/2 |
| 6,004,243 | A * | 12/1999 | Ewert | 482/8 |
| 6,126,571 | A * | 10/2000 | Parks | 482/4 |
| 6,142,913 | A * | 11/2000 | Ewert | 482/8 |
| 2002/0055422 | A1 * | 5/2002 | Airmet et al. | 482/61 |

* cited by examiner

*Primary Examiner*—Lori Amerson
*Assistant Examiner*—Tam Nguyen
(74) *Attorney, Agent, or Firm*—Charles E. Baxley

(57) ABSTRACT

A virtual reality bicycle-training simulation platform is disclosed to include a rotary steering unit and rear wheel rack that support the front and rear wheels of a bicycle and are linked to a multimedia system for outputting a signal to the multimedia system indicative of the biasing of the front wheel of the bicycle and controllable by the multimedia system to impart a damping resistance to the rear wheel of the bicycle.

19 Claims, 13 Drawing Sheets

VIRTUAL REALITY BICYCLE-TRAINING SIMULATION PLATFORM

BACKGROUND OF THE INVENTION

1. Field of the Invention

The present invention relates to a bicycle-training platform and more specifically, to a virtual reality bicycle-training simulation platform that acts as interface means between a bicycle and a multimedia system.

2. Description of the Related Art

People may use a bicycle for physical exercise indoors. A bicycle comprises a base, a flywheel pivotally supported on the base, a pedal mechanism for pedaling by the user to rotate the flywheel, a pair of handlebars for the holding of the hands when the user pedaling the pedal mechanism, and a damper that imparts a damping resistance to the flywheel.

However, it is monotonous to ride a bicycle. The player may get tired of riding the bicycle soon. In order to attract people to ride a bicycle, a TV monitor, computer monitor, virtual reality eyepieces, or the like may be incorporated with a bicycle, for enabling the player to simulate riding of a bicycle in the open field. The player controls the handlebars and flywheel speed to link the bicycle to the virtual reality. The virtual reality system may provide a feedback control to change the damping resistance and/or tilting angle of the bicycle subject to the road condition in the virtual reality.

However, to enjoy the aforesaid virtual reality game at home, one should purchase the whole system including the bicycle. The bicycle of this system has a fixed size, not suitable for all people of different body sizes. Further, it is not economic to buy the whole system including the bicycle if the consumer already has a bicycle at home.

SUMMARY OF THE INVENTION

The present invention has been accomplished under the circumstances in view. It is one object of the present invention to provide a virtual reality bicycle-training simulation platform, which can be used with any of a variety of existing bicycles without changing the physical structure of the bicycle. It is another object of the present invention to provide a virtual reality bicycle-training simulation platform, which works as an interface means between a multimedia system and a bicycle. According to one aspect of the present invention, the virtual reality bicycle-training simulation platform comprises a steering unit and a rear wheel rack for supporting the front wheel and rear wheel of a bicycle and linking the bicycle to a multimedia system. The steering unit outputs a directional signal to the multimedia system when the user changes the direction of the front wheel of the bicycle. The rear wheel rack imparts a damping resistance to the rear wheel of the bicycle subject to the control of the multimedia system. According to another aspect of the present invention, the steering unit comprises a wheel rim seat for supporting the front wheel of the bicycle, and two adjustment blocks mounted on the wheel rim seat and adjustable subject to the size of the front wheel of the bicycle. According to still another aspect of the present invention, the rear wheel rack can be adjusted horizontally and vertically to fit the size of the rear wheel of the bicycle and the length of the wheel axle of the rear wheel of the bicycle.

DETAILED DESCRIPTION OF THE PREFERRED EMBODIMENT

Figure 1:
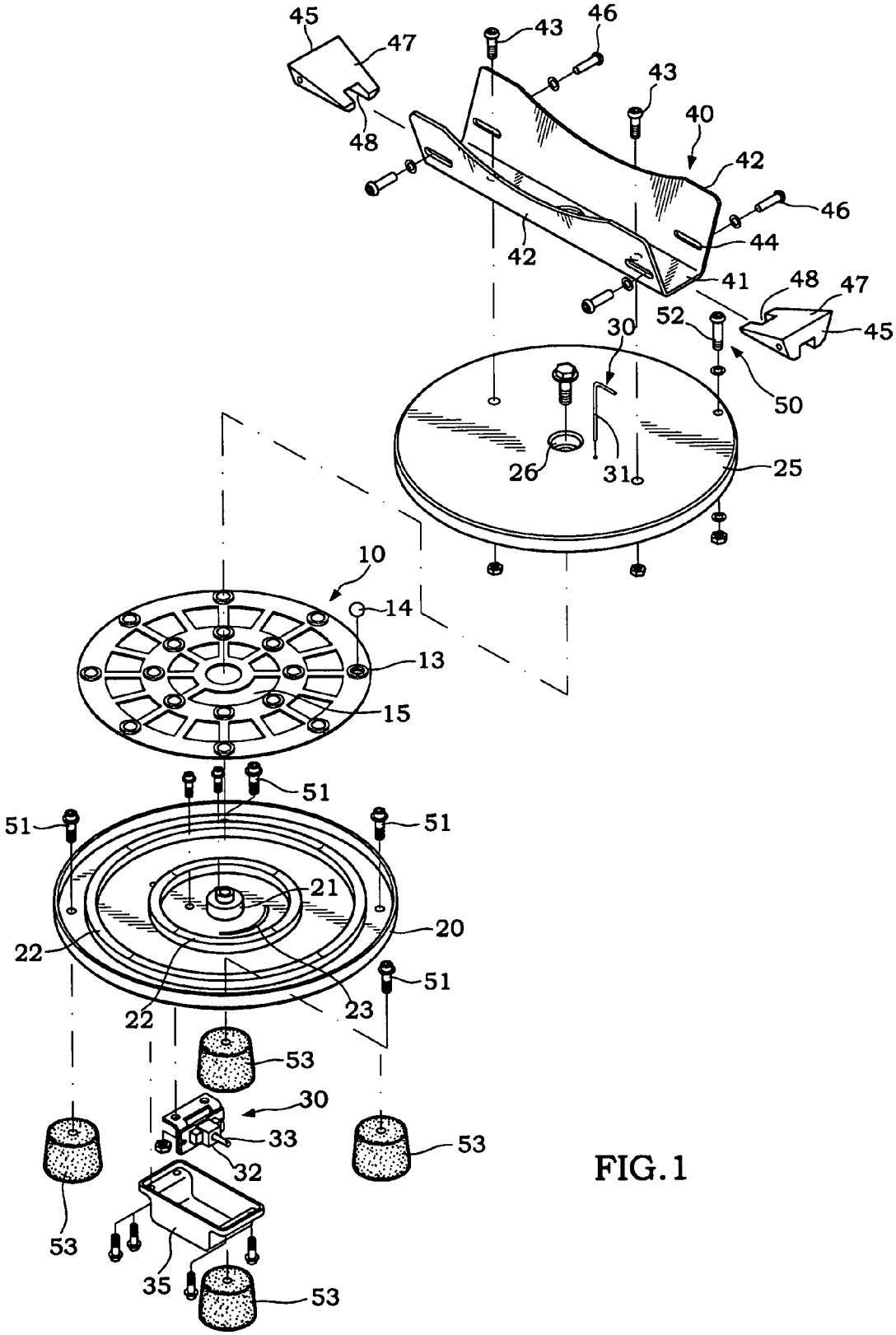
FIG. 1 is an exploded view of a steering unit for a virtual reality bicycle-training simulation platform according to the present invention.
Figure 2:
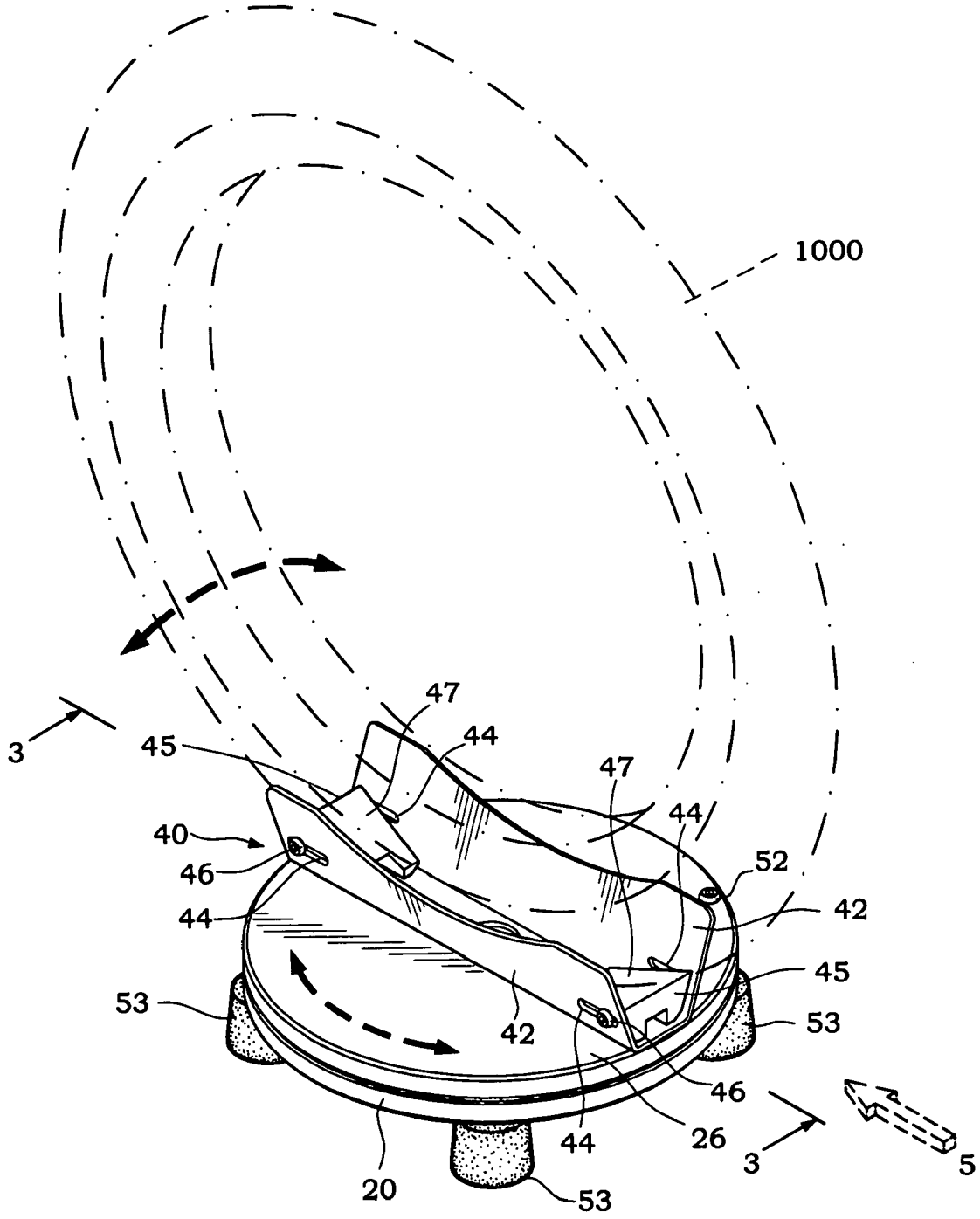
FIG. 2 is a schematic drawing showing the steering unit assembled and coupled to a bicycle's rear wheel according to the present invention.
Figure 3:
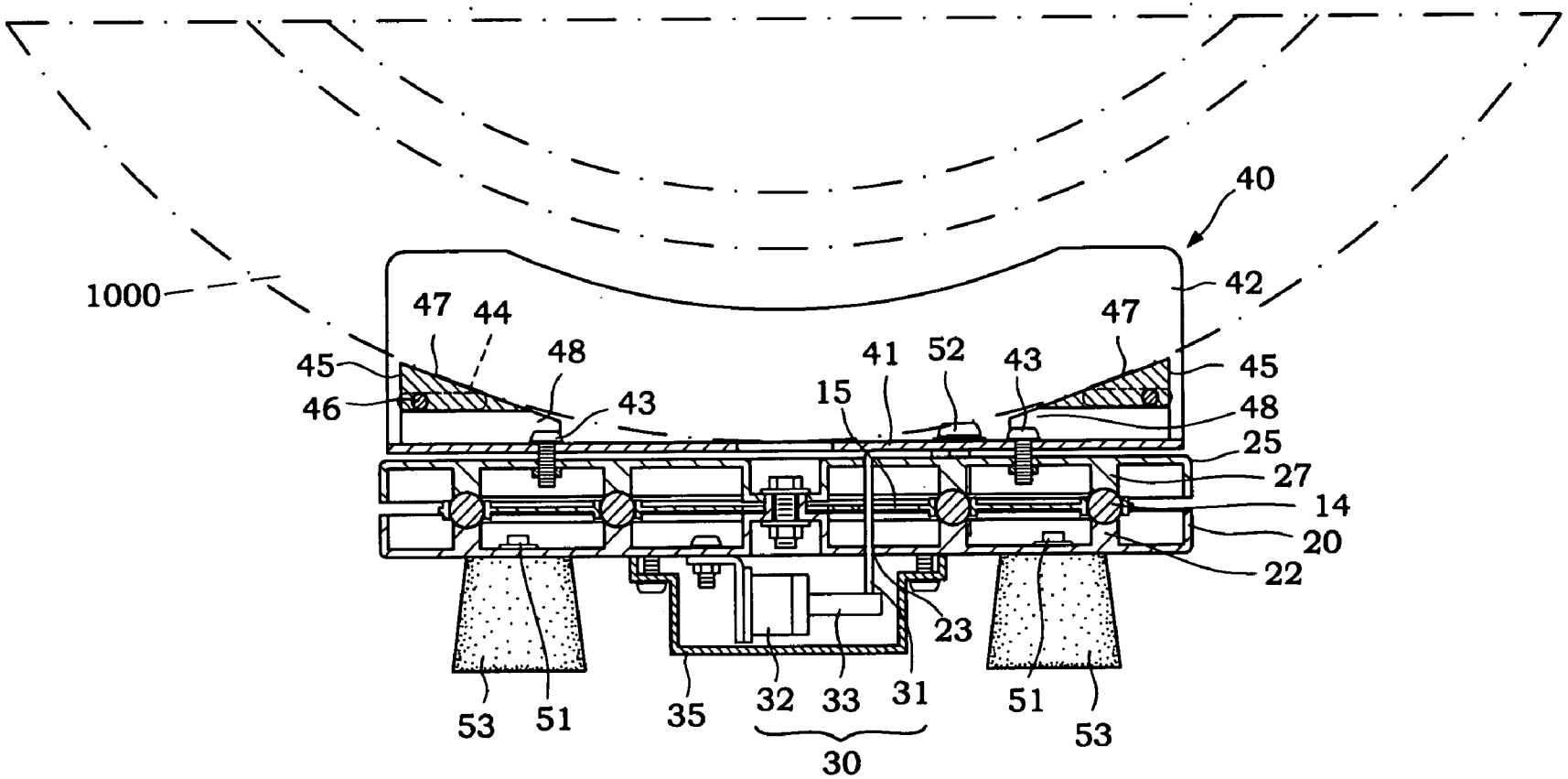
FIG. 3 is a sectional view taken in an enlarged scale along line 3—3 of FIG. 2.

Referring to FIGS. 1~3, a virtual reality bicycle-training simulation platform in accordance with the present invention comprises a steering unit. The steering unit comprises:

a fixed base 20, which comprises an upright center hub 21, and a plurality of annular grooves 22 concentrically formed in the top wall around the upright center hub 21;

a flat ball bearing holder plate 10, which is supported on the fixed base 20 and comprises a plurality of evenly distributed ball bearing blocks 13 that hold a respective steel ball 14 that is rotatably supported in the respective ball bearing block 13 and partially supported in one annular groove 22 of the fixed base 20;

a rotary table 25, which is supported on the steel balls 14 in the ball bearing blocks 13 of the flat ball bearing holder plate 10, having a center axle hole 26 coupled to the upright center hub 21 of the fixed base 20 and a plurality of annular grooves 27 concentrically formed in the bottom wall around the center axle hole 26 and respectively coupled to the steel balls 14 in the ball bearing blocks 13 of the flat ball bearing holder plate 10;

a steering sensor 30, which comprises a first rocker 31 vertically fixedly fastened to the rotary table 25 at an eccentric location and inserted through an arched slot 15 at the flat ball bearing holder plate 10 and an arched slot 23 at the fixed base 20, a sensor body 32 fixedly mounted on the bottom wall of the fixed base 20 and covered by a cover 35, and a second rocker 33 horizontally extended from the sensor body 32 and connected to the free end of the first rocker 31 remote from the rotary table 25;

a wheel rim seat 40, which comprises a bottom plate 41 fixedly fastened to the top wall of the rotary table 20 with fastening members, for example, screws 43, and two side plates 42 that are fixedly connected to the bottom plate 41 at two opposite lateral sides and each have an elongated slot 44 horizontally disposed at each of the two distal ends thereof;

two adjustment blocks 45, which respectively adjustably fastened to the elongated slots 44 of the wheel rim seat 40 with fastening members 46 and supported between the two side plates 42 near the two ends of the wheel rim seat 40, each having a top wheel rim bearing surface 47 and a front wheel rim positioning notch 48; and a turning angle control 50, which comprises a plurality of fixed bolts 51 mounted on the fixed base 20, and a plurality of movable bolts 52 mounted on the rotary table 25.

Figure 6:
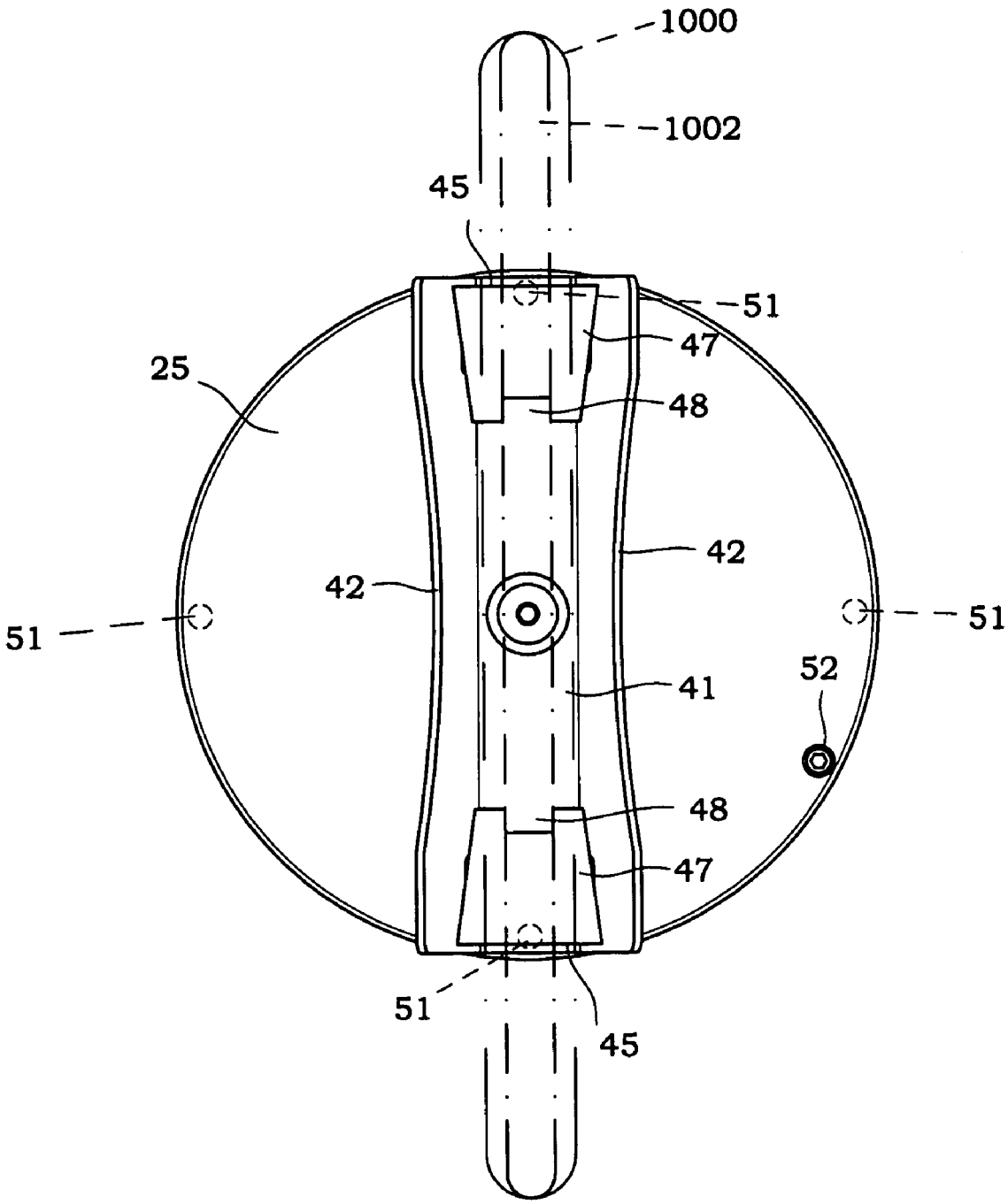
FIG. 6 is a top view of FIG. 2.

Referring to FIG. 6 and FIGS. 1 and 2 again, when rotating the rotary table 25 on the fixed base 20 to a predetermined angle, the movable bolts 52 will be stopped at the fixed bolts 51 to limit the turning angle of the rotary table 25 relative to the fixed base 20. Further, shock-absorbing and anti-slip foot members 53 are fixedly fastened to the bottom wall of the fixed base 20 by means of the fixed bolts 51.

Figure 7:
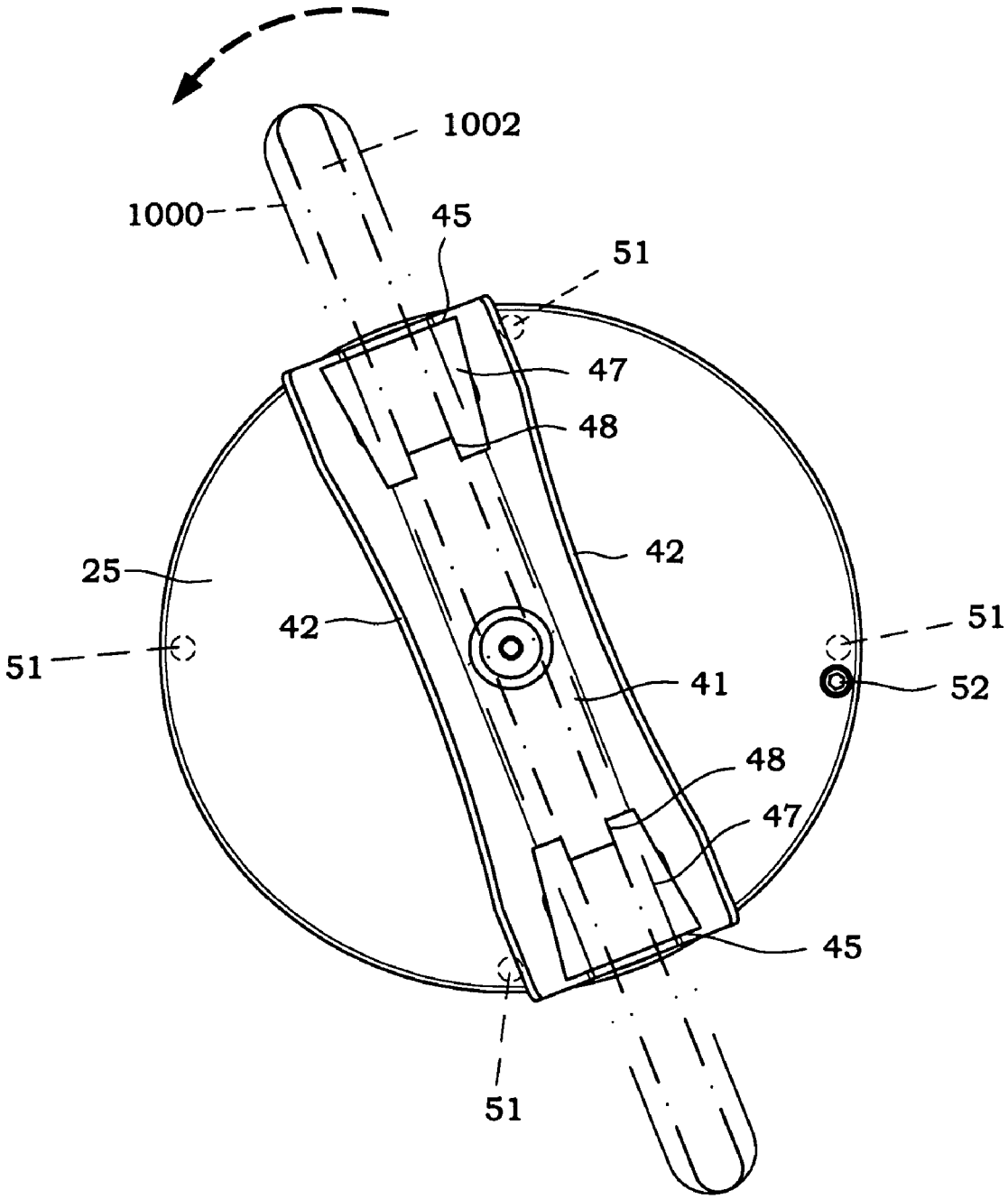
FIG. 7 corresponds to FIG. 6, showing the rotary table turned with the bicycle front wheel.

Referring to FIG. 7 and FIGS. 2 and 6 again, the wheel rim of the bicycle's front wheel 1000 is set in wheel rim seat 40 of the aforesaid steering unit between the two side plates 42. When the user turning the bicycle handlebars to bias the front wheel 1000, the rotary table 25 is synchronously turned relative to the fixed base 20, and the first rocker 31 is moved with the rotary table 25 to bias the second rocker 33, thereby causing the sensor body 32 to output a signal indicative of the turning direction of the front wheel 1000. This directional signal is sent to the CPU (central processing unit) of the multimedia system (not shown) for further processing.

Figure 4:
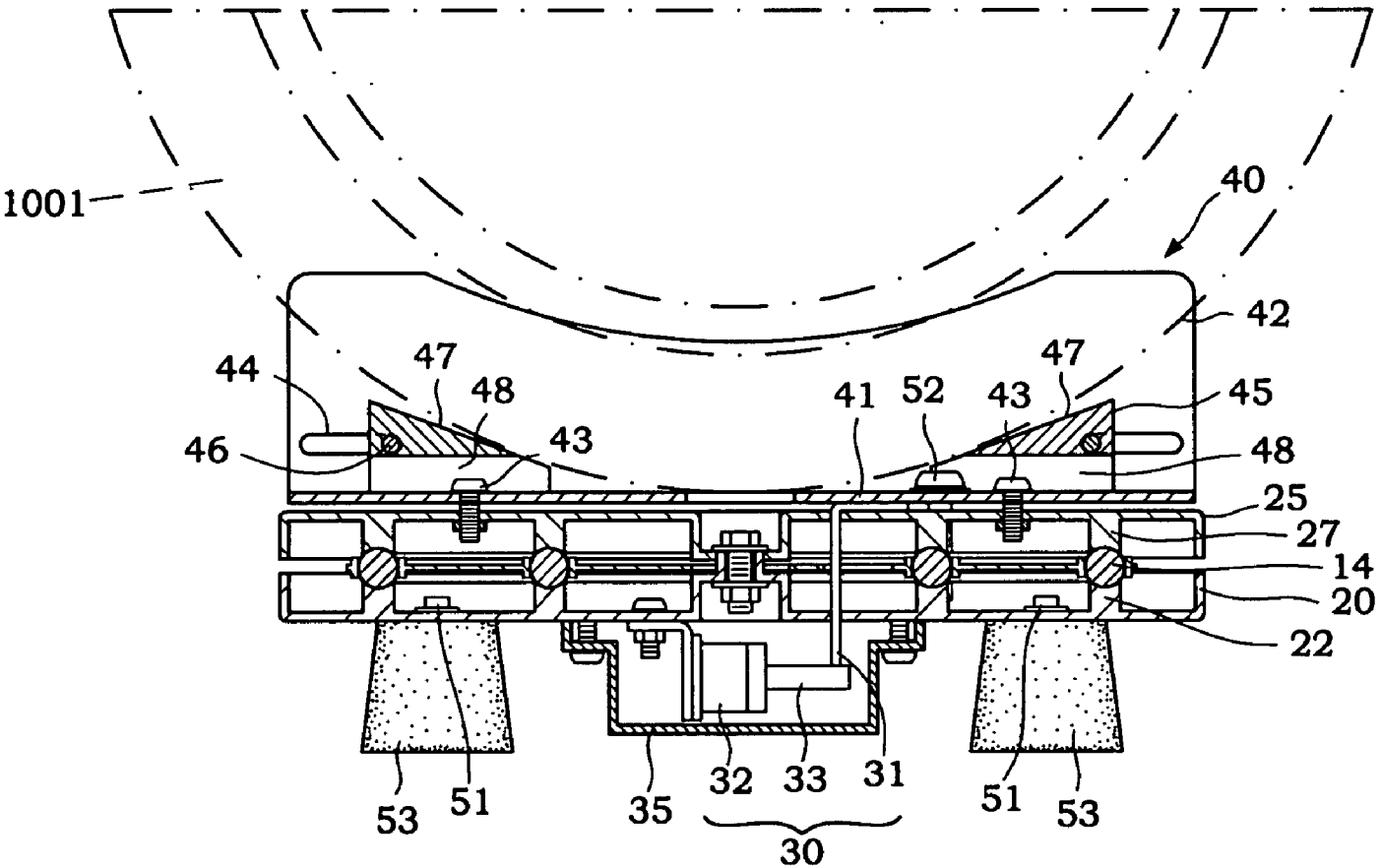
FIG. 4 is similar to FIG. 3 but showing a different size of bicycle front wheel supported on the wheel rim seat.
Figure 5:
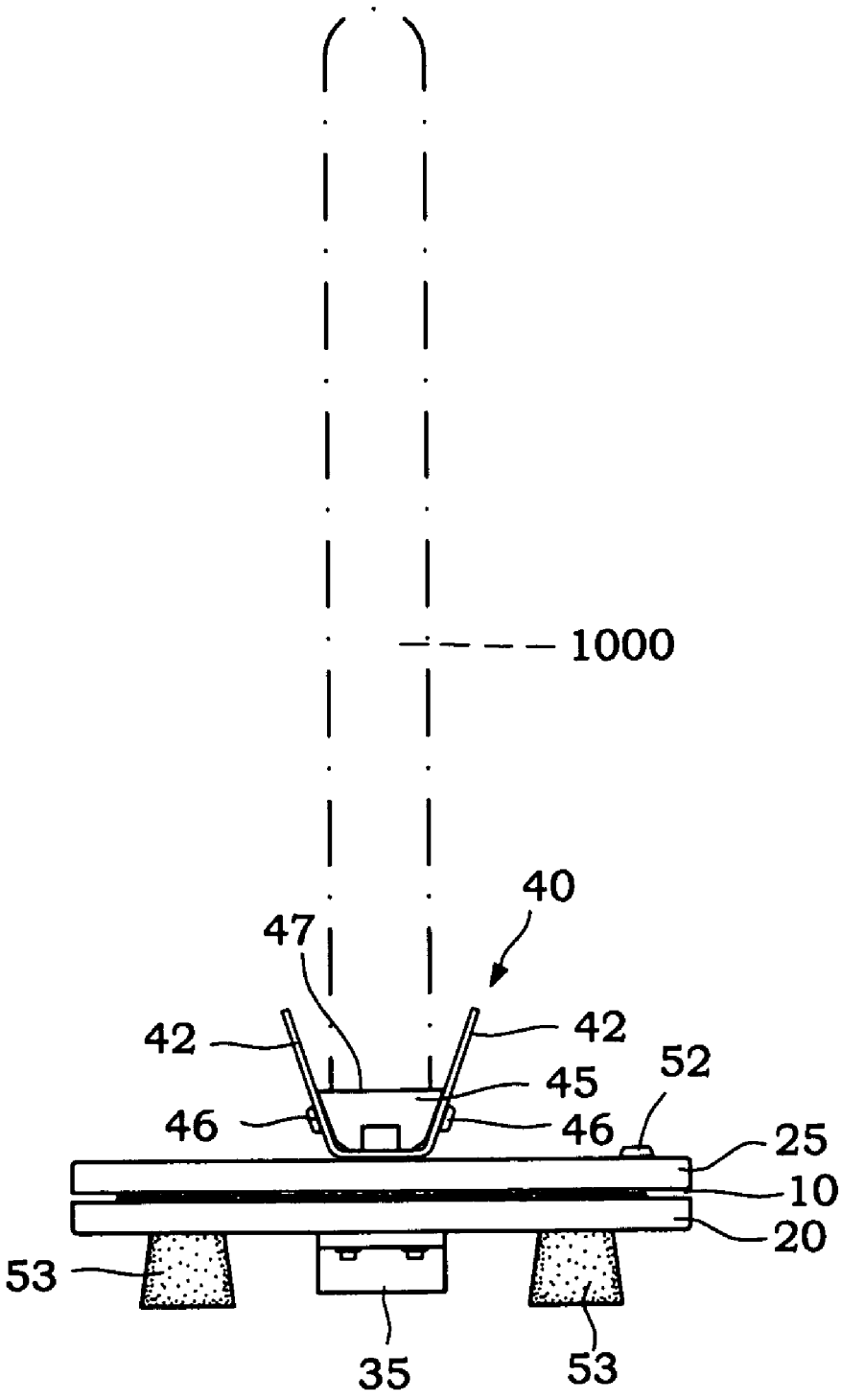
FIG. 5 corresponds to FIG. 2 when viewed in the direction of Arrow 5.

Referring to FIGS. 3 and 4, the wheel rim seat 40 fits different front wheels 1000 and 1001 that have different diameters. When loosened the fastening members 46, the adjustment blocks 45 can be respectively moved along the elongated slots 44 to adjust the distance between the two adjustment blocks 45 subject to the diameter of the front wheel 1000 or 1001, keeping the top wheel rim bearing surfaces 47 of the adjustment blocks 45 in close contact with the wheel rim of the front wheel 1000 or 1001. When set, the fastening members 46 are fastened tight again to affix the adjustment blocks 45 in position.

Referring to FIGS. 6 and 7 again, the pitch between the two side plates 42 fits regular commercial bicycle front wheels. When a bicycle front wheel 1002 having a narrow wheel width (such as the front wheel of a racing bicycle) is used, the wheel rim of the bicycle front wheel 1002 can be engaged into the front wheel rim positioning notches 48 of the two adjustment blocks 45.

Figure 8:
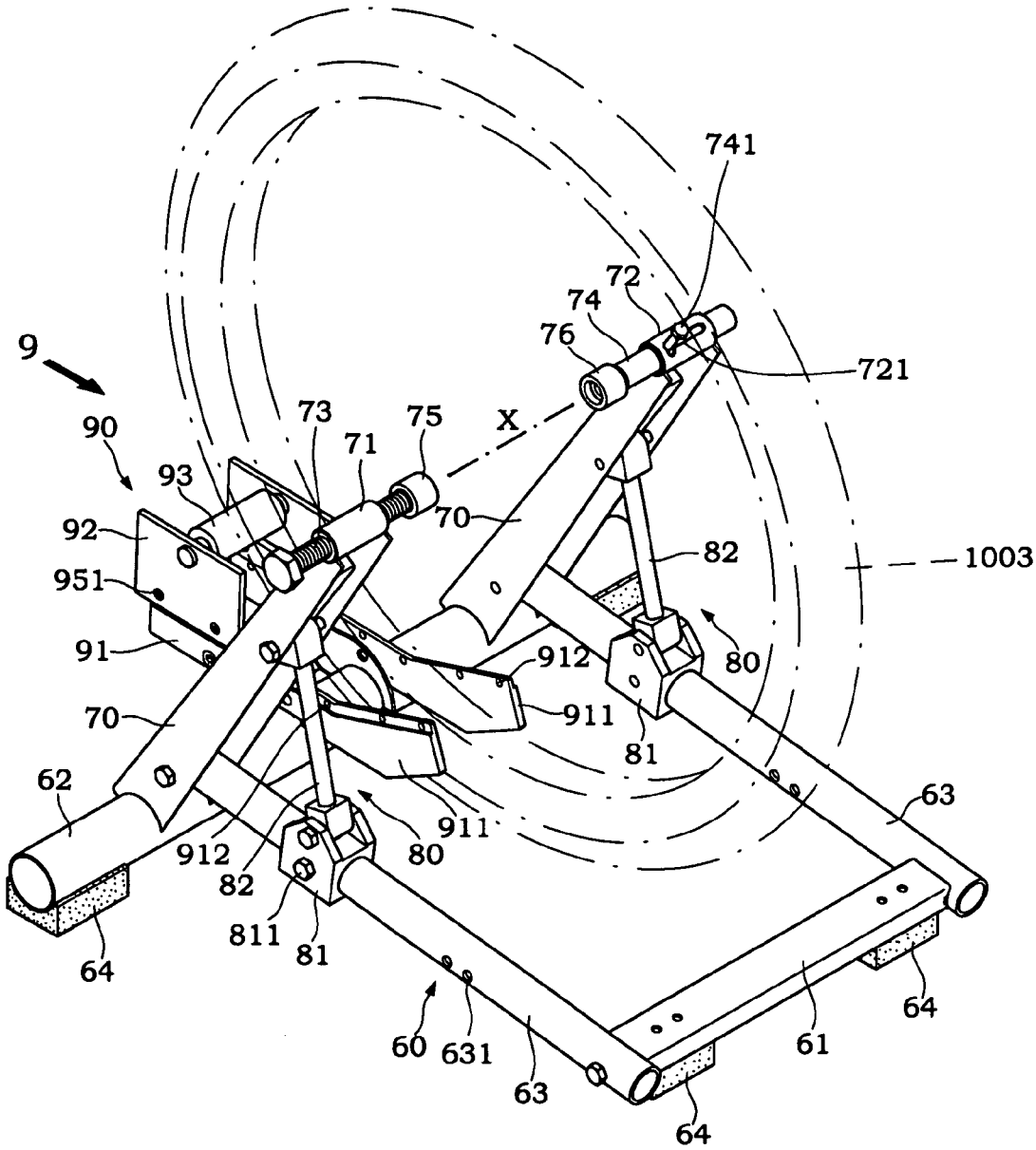
FIG. 8 is a schematic drawing showing a bicycle's front wheel supported on a rear wheel rack according to the present invention.
Figure 9:
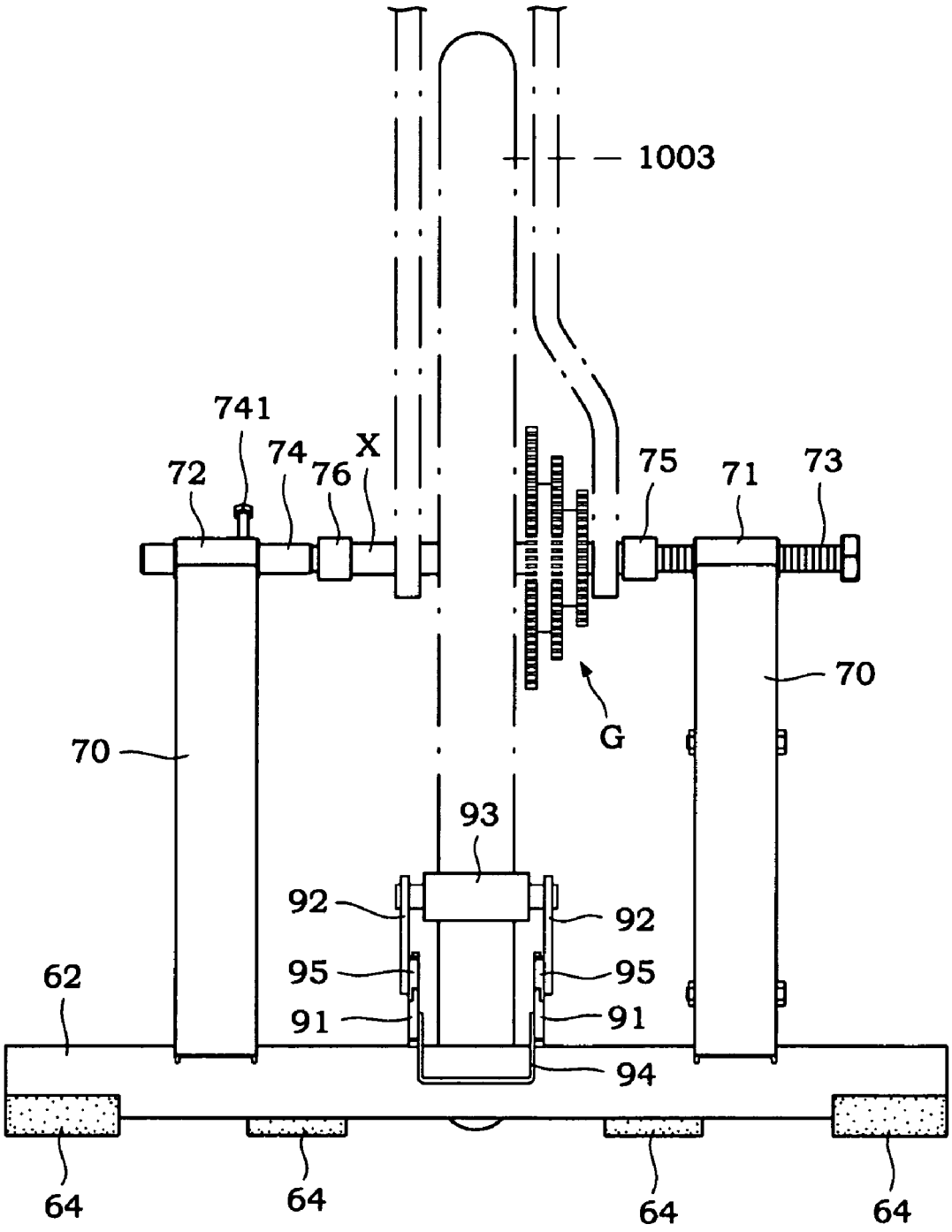
FIG. 9 corresponds to FIG. 8 when viewed in the direction of Arrow 9.

Referring to FIGS. 8 and 9, the virtual reality bicycle-training simulation platform of the present invention further comprises a rear wheel rack. The rear wheel rack comprises:

a base frame 60, which comprises a transverse front bar 61, a transverse rear bar 62, a plurality of shock-absorbing and anti-slip foot members 64 respectively symmetrically fastened to the transverse front bar 61 and the transverse rear bar 62 at the bottom side, and two side bars 63 each having a fixed end respectively pivotally connected to the two distal ends of the transverse front bar 61 and a free end;

two rear wheel supports 70, which each have one end, namely, the bottom end respectively pivotally connected to the free ends of the side bars 63 and smoothly arched to fit the periphery of the transverse rear bar 62 and the other end, namely, the top end fixedly provided with a transverse (horizontal) axle holder 71 or 72, a first locating member 73 formed of a screw bolt and threaded into (an inner thread of) one transverse axle holder 71 (according to this embodiment, the transverse axle holder 71 is a tubular nut horizontally fixedly provided at the top end of one rear wheel support 70), a second locating member 74 inserted through the other transverse axle holder 72 (according to this embodiment, the transverse axle holder 72 is a barrel), a lock screw 741 inserted through an elongated slot 721 at the transverse axle holder 72 and threaded into the second locating member 74 for locking the second locating member 74 to the transverse axle holder 72 when fastened up and for enabling the second locating member 74 to be moved axially relative to the transverse axle holder 72 to adjust the distance between the first locating member 73 and the second locating member 74 when loosened, a first wheel axle bearing 75 fixedly provided at one end of the first locating member 73 and adapted to support one end of the wheel axle X of the bicycle rear wheel 1003, and a second wheel axle bearing 76 fixedly provided at one end of the second locating member 74 and adapted to support the other end of the wheel axle X of the bicycle rear wheel 1003;

two adjustment devices 80, which comprise each a coupling block 81 slidably coupled to one of the side bars 63 and lockable thereto, a lock screw 811 mounted in the coupling block 81 and selectively threaded into one of a longitudinal series of screw holes 631 at the respective side bar 63 to lock the coupling block 81 to the respective side bar 63 at the desired location, and a strut 82 that has one end pivotally connected to the coupling block 81 and the other end pivotally connected to one of the rear wheel supports 70; and a rear wheel damper 90, which comprises two locating frames 91 that are respectively fastened to the transverse rear bar 62 at right angles and arranged in parallel and have each a respective front end 911 extending in direction toward the transverse front bar 61 and curved upwards, two wheel holder plates 92 respectively and vertically adjustably fastened to the locating frames 91, and a roller 93 pivotally supported between the wheel holder plates 92.

Figure 10:
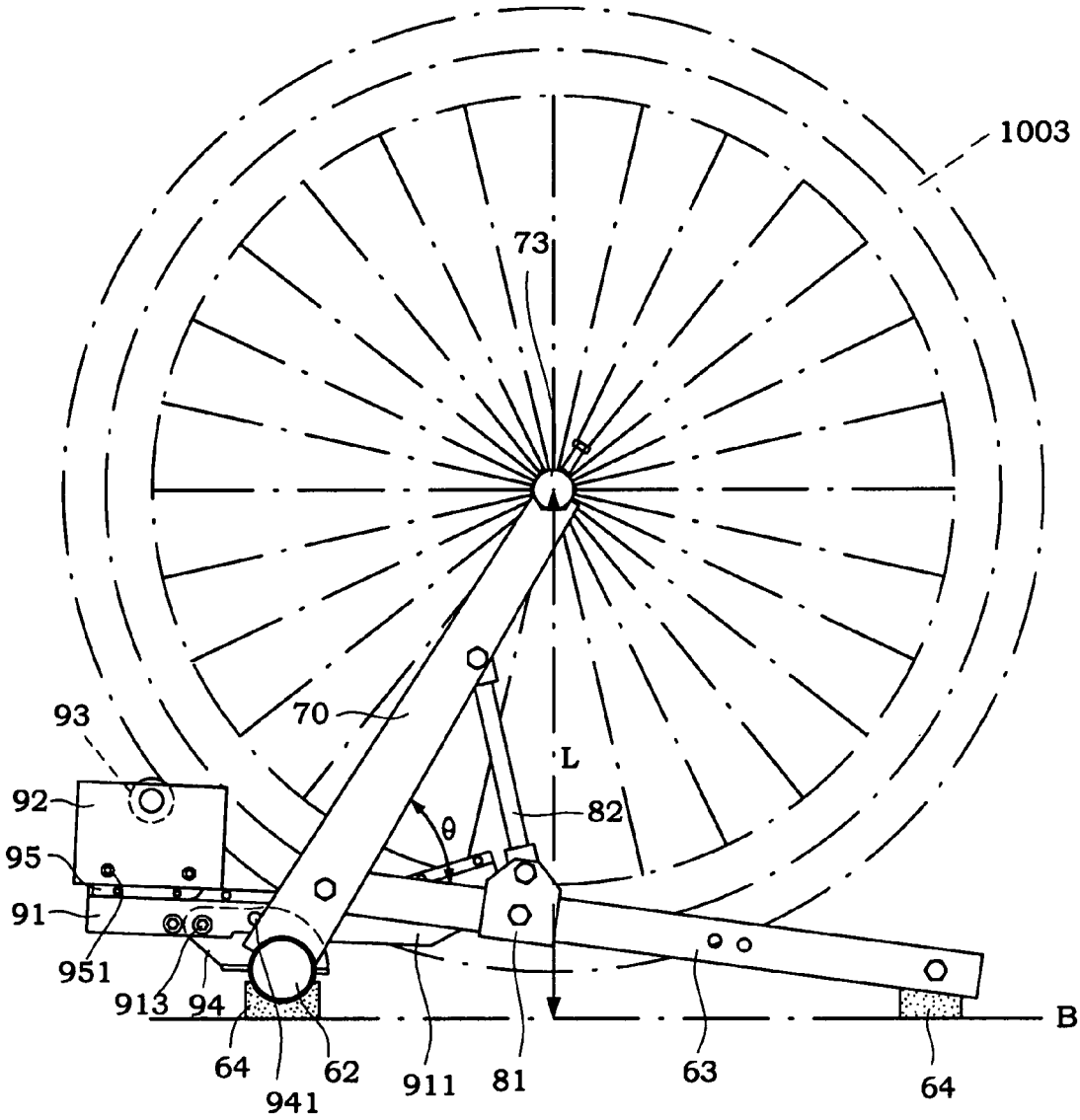
FIG. 10 is a schematic side view of a part of the present invention, showing a bigger bicycle rear wheel supported on the rear wheel rack.

Referring to FIG. 10, a U-lug 94 is fixedly provided at the transverse rear bar 62 on the middle to support the rear wheel damper 90. The U-lug 94 has two horizontal rows of mounting holes 941 symmetrically disposed at two opposite lateral sides. The locating frames 91 of the rear wheel damper 90 are selectively fastened to the mounting holes 941 at two opposite lateral sides of the U-lug 94 with lock screws 913.

Referring to FIGS. 8 and 9 again, the wheel holder plates 92 are respectively connected to the locating frames 91 by a respective connecting member 95. The connecting members 95 each have a top end fixedly fastened to the respective wheel holder plate 92 and a bottom end selectively fastened to one of a series of vertically spaced mounting holes 912 at the respective locating frame 91 with a lock screw 951.

Figure 11:
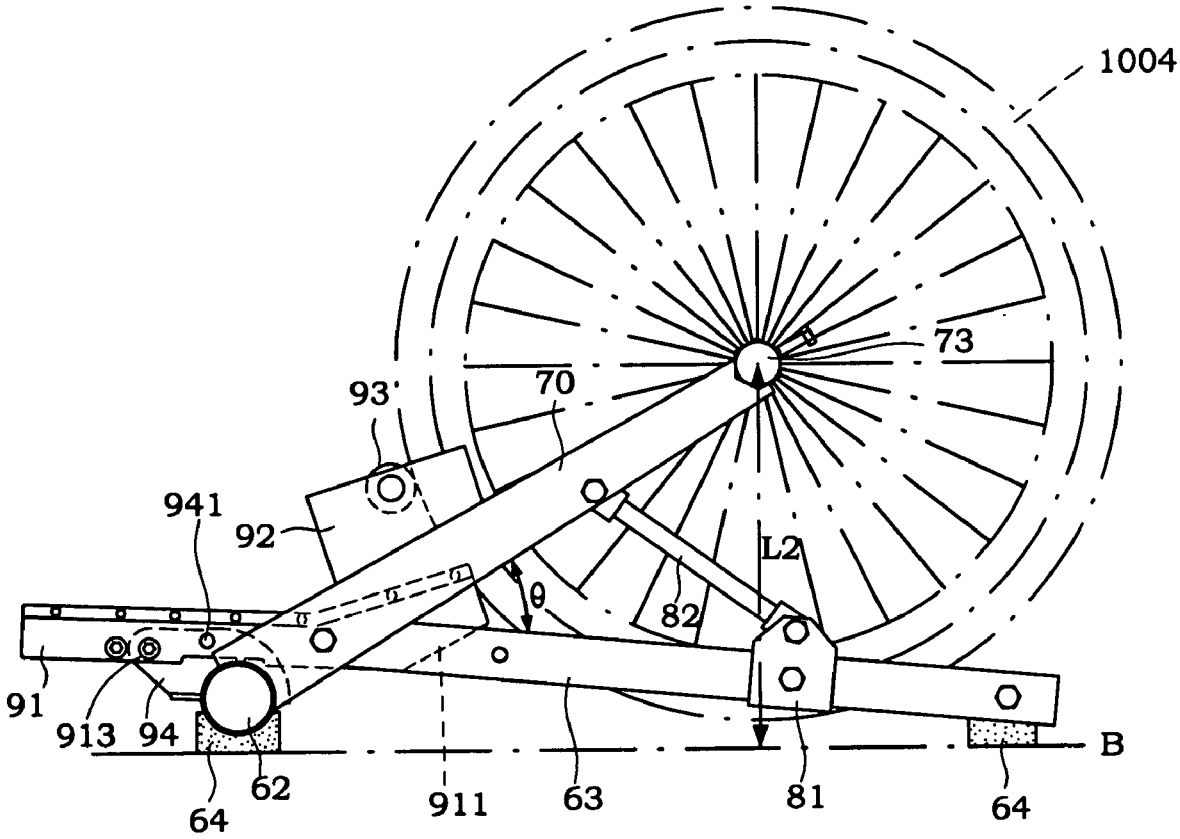
FIG. 11 is a schematic side view of a part of the present invention, showing a smaller bicycle rear wheel supported on the rear wheel rack.

Referring to FIGS. 10 and 11, the rear wheel rack fits different bicycle rear wheels 1003 and 1004 that have different diameters. The coupling blocks 81 of the adjustment devices 80 can be moved along the side bars 63 to adjust the contained angle θ between the rear wheel supports 70 and the side bars 63. For example, the user can move the coupling blocks 81 of the adjustment devices 80 along the side bars 63 toward the transverse rear bar 62 to increase the contained angle θ between the rear wheel supports 70 and the side bars 63 and to relatively extend the distance L between the axis passing through the locating members 73 and 74 and the floor B so as to fit a relatively greater bicycle rear wheel 1003. On the contrary, the user can move the coupling blocks 81 of the adjustment devices 80 along the side bars 63 toward the transverse front bar 61 to reduce the contained angle θ between the rear wheel supports 70 and the side bars 63 and to relatively shorten the distance L between the axis passing through the locating members 73 and 74 and the floor B so as to fit a relatively smaller bicycle rear wheel 1004.

Further, the length of the rear wheel axle of the rear wheel of a bicycle may varies with the number of gears of the freewheel gear cluster used. For example, the rear wheel axle of the rear wheel of a bicycle using a freewheel gear cluster that has a relatively greater number of gears is relatively longer than the rear wheel axle of the rear wheel of a bicycle using a freewheel gear cluster that has a relatively smaller number of gears.

Referring to FIG. 9 again, the rear wheel rack of the present invention fits different rear wheel axles having different lengths. During installation, the lock screw 741 is loosened, and then the second locating member 74 is moved relative to the respective transverse axle holder 72 to adjust the distance between the bicycle rear wheel 1003 and the respective rear wheel support 70 subject to a predetermined range, and then the lock screw 741 is fastened up to lock the second locating member 74 in position, and then the first locating member 73 is rotated relative to the respective transverse axle holder 72 to move the first wheel axle bearing 75 into positive connection with the end of the wheel axle X of the bicycle rear wheel 1003 in proximity to the freewheel gear cluster G.

Referring to FIGS. 10 and 11, the position of the rear wheel damper 90 can be adjusted subject to the diameter of the bicycle rear wheel so that the roller 93 is maintained in tangent to the wheel rim of the bicycle rear wheel 1003 or 1004. When a relatively smaller bicycle rear wheel 1004 is used, the wheel holder plates 92 can be positioned onto the locating frames 91 near their upwardly curved front ends 911. Further, a magnetic force is used to control damping resistance to the rotation of the roller 93. This magnetic force type damping mechanism can easily be achieved by conventional techniques. When increasing the damping resistance to the roller 93, the damping resistance to the bicycle rear wheel 1003 or 1004 is relatively increased, and the user requires much effort to propel the bicycle. On the contrary, when reducing the damping resistance to the roller 93, the user can propel the bicycle with less effort. The control program of the multimedia system controls the damping resistance to the roller 93 so that the damping resistance to the bicycle rear wheel is linked to the virtual reality.

Figure 12:
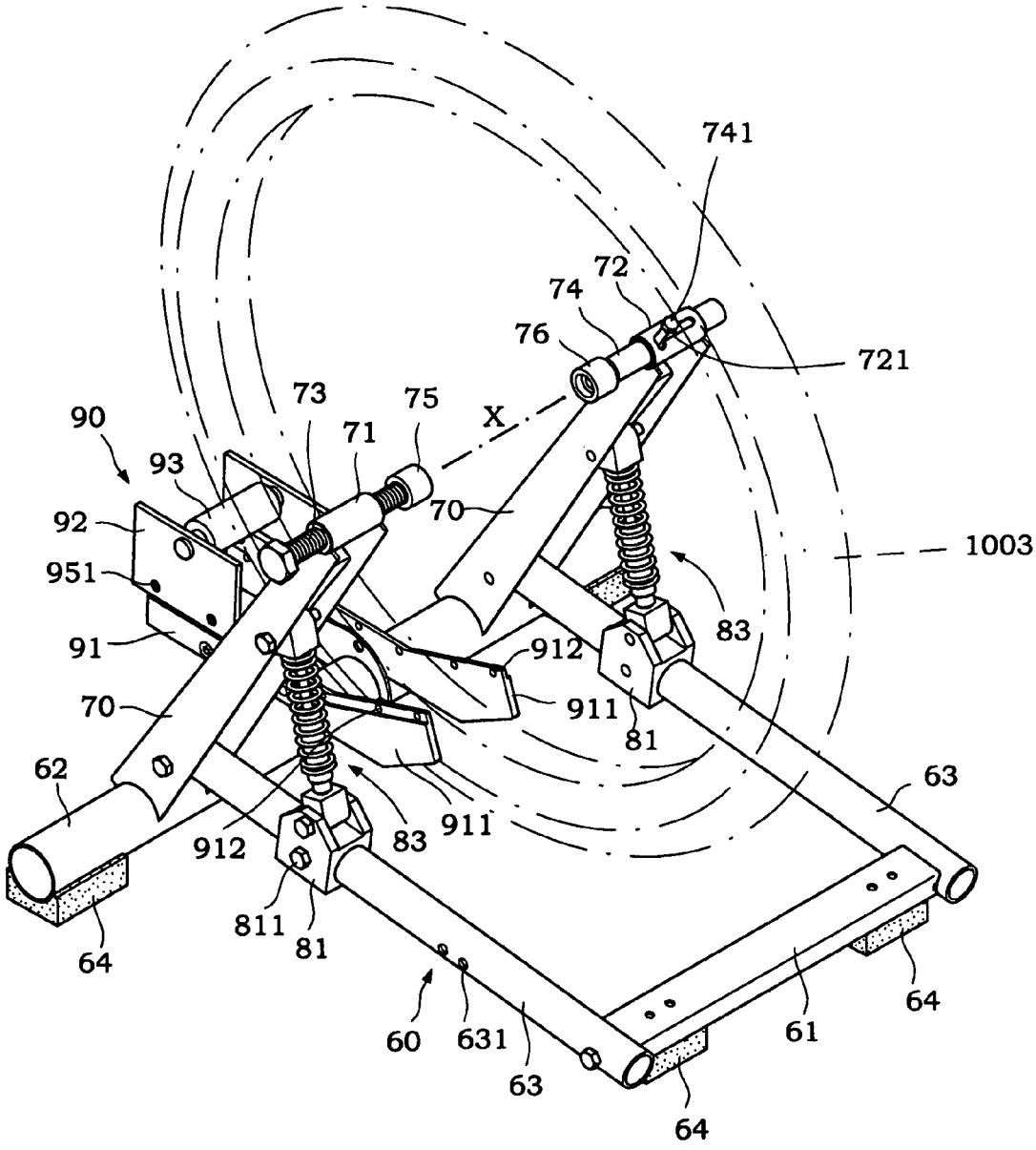
FIG. 12 is similar to FIG. 8 but showing shock absorbers used and connected between the coupling blocks and the rear wheel supports.

FIG. 12 shows an alternate form of the present invention. According to this embodiment, the adjustment devices 80 each comprise a coupling block 81 slidably coupled to one of the side bars 63 and lockable thereto with a lock screw 811, and a shock absorber 82 that has one end pivotally connected to the coupling block 81 and the other end pivotally connected to one of the rear wheel supports 70.

Figure 13:
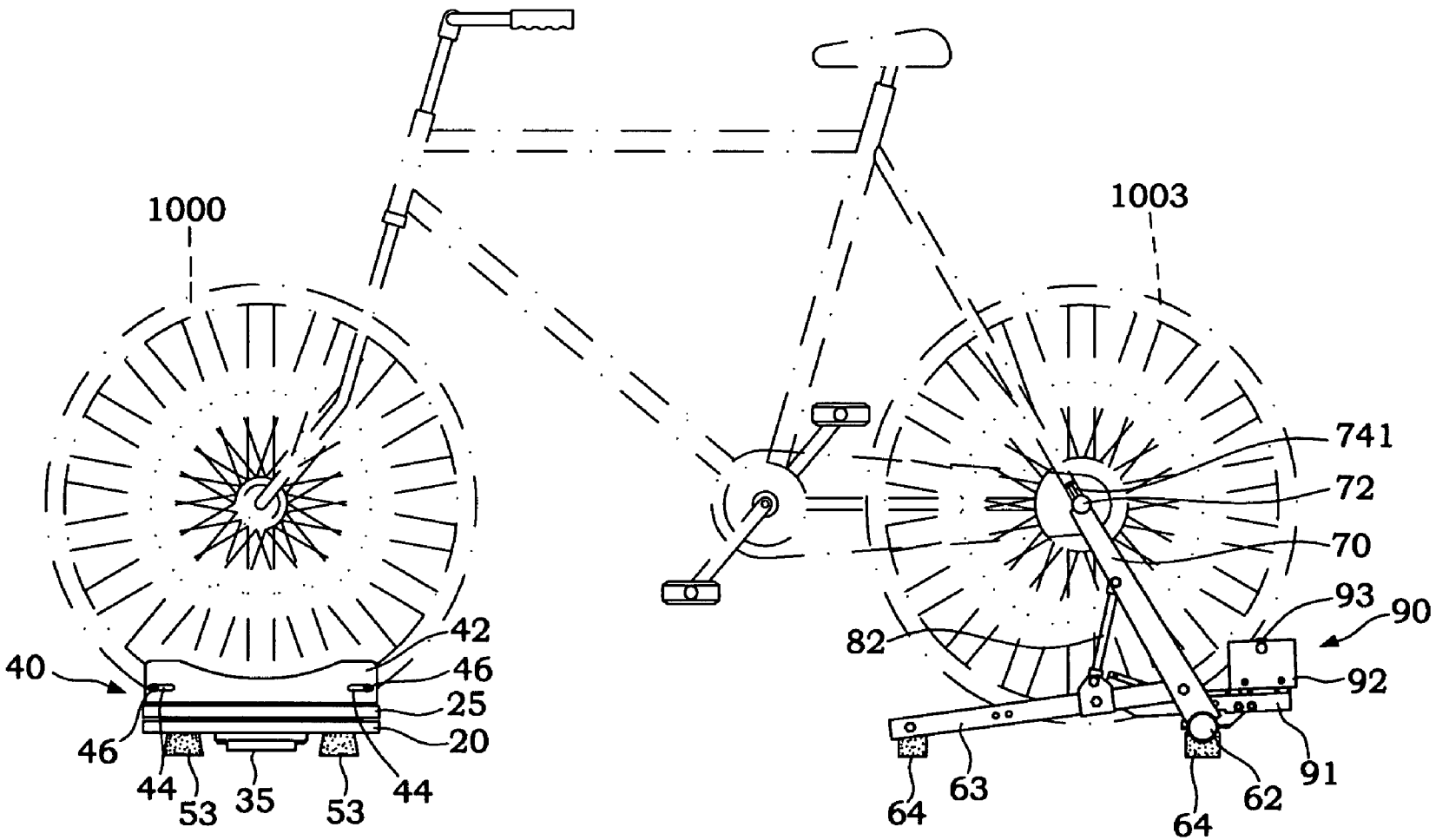
FIG. 13 is a schematic plain view showing a bicycle supported on the virtual reality bicycle-training simulation platform according to the present invention.

FIG. 13 is a plain view of the present invention, showing the front wheel 1000 and rear wheel 1003 of a bicycle respectively supported on the steering unit and rear wheel rack of the virtual reality bicycle-training simulation platform.

Although particular embodiments of the invention have been described in detail for purposes of illustration, various modifications and enhancements may be made without departing from the spirit and scope of the invention.

What the invention claimed is:

1. A virtual reality bicycle-training simulation platform that links the front wheel and rear wheel of a bicycle to a multimedia system, comprising:

a steering unit that supports the front wheel of said bicycle, said steering unit comprising a rotary table, a wheel rim seat mounted on said rotary table for carrying the front wheel of said bicycle, two adjustment blocks respectively mounted on two distal ends of said wheel rim seat and movable relative to each other and lockable to said wheel rim seat for holding down the front wheel of said bicycle on said wheel rim seat, said adjustment blocks each having a top wheel rim bearing surface, and a steering sensor adapted to detect direction and amount of rotation of said rotary table upon biasing of the front wheel of said bicycle by a user and to output a signal to said multimedia system indicative of the direction and amount of rotation of said rotary table; and a rear wheel rack that supports the rear wheel of said bicycle, said rear wheel rack comprising a base frame, two rear wheel supports pivotally supported on said base frame and arranged in parallel, two coupling blocks respectively slidably coupled to said base frame at two opposite lateral sides, two struts coupled between said coupling blocks and said rear wheel supports, two locating members respectively and horizontally adjustably mounted on said rear wheel supports remote from said base frame and respectively coupled to the two distal ends of the wheel axle of the rear wheel of said bicycle to support the rear wheel of said bicycle on said rear wheel supports, and a damper controllable by said multimedia system to impart a damping resistance to the rear wheel of said bicycle.

2. The virtual reality bicycle-training simulation platform as claimed in claim 1, wherein said wheel rim seat comprises a bottom plate and two side plates provided at two opposite lateral sides of said bottom plate.

3. The virtual reality bicycle-training simulation platform as claimed in claim 2, wherein said steering unit further comprises an adjustable connection structure adapted to adjustably lock said adjustment blocks to said two side plates of said wheel rim seat.

4. The virtual reality bicycle-training simulation platform as claimed in claim 3, wherein said adjustable connection structure comprises two symmetrical pairs of elongated slots respectively formed in said two side plates of said wheel rim seat near the two distal ends, and a plurality of fastening members respectively inserted through said elongated slots and fastened to said adjustment blocks for affixing said adjustment blocks to said side plates of said wheel rim seat.

5. The virtual reality bicycle-training simulation platform as claimed in claim 1, wherein said adjustment blocks each have a front locating notch for engaging the wheel rim of the front wheel of said bicycle.

6. The virtual reality bicycle-training simulation platform as claimed in claim 1, wherein said steering unit further comprises a base, which supports said rotary table for allow rotation of said rotary table on said base.

7. The virtual reality bicycle-training simulation platform as claimed in claim 6, wherein said steering unit further comprises a flat ball bearing holder plate supported between said base and said rotary table, said flat ball bearing holder plate holding a plurality of steel balls that are rotatably supported between said base and said rotary table.

8. The virtual reality bicycle-training simulation platform as claimed in claim 6, wherein said steering unit further comprises a turning angle control adapted to limit the rotation of said rotary table on said base to a predetermined angle.

9. The virtual reality bicycle-training simulation platform as claimed in claim 8, wherein said turning angle control comprises a plurality of movable bolts respectively mounted on said rotary table and movable with said rotary table relative to said base, and a plurality of fixed bolts respectively mounted on said base and adapted to stop said movable bolts.

10. The virtual reality bicycle-training simulation platform as claimed in claim 6, wherein said base comprises a plurality of shock absorbing and anti-slip foot members fixedly provided at a bottom side thereof.

11. The virtual reality bicycle-training simulation platform as claimed in claim 1, wherein said damper of said rear wheel rack comprises a roller controllable by said multimedia system to impart a damping resistance to said rear wheel of said bicycle.

12. The virtual reality bicycle-training simulation platform as claimed in claim 11, wherein said damper further comprises two locating frames that are respectively fastened to said base frame and arranged in parallel, and two wheel holder plates respectively and vertically adjustably fastened to said locating frames for supporting said roller.

13. The virtual reality bicycle-training simulation platform as claimed in claim 12, wherein said locating frames of said damper each have a front end curved forwardly upwards.

14. The virtual reality bicycle-training simulation platform as claimed in claim 1, wherein said struts of said rear wheel rack are straight rod members.

15. The virtual reality bicycle-training simulation platform as claimed in claim 1, wherein said struts of said rear wheel rack are respectively formed of a shock absorber.

16. The virtual reality bicycle-training simulation platform as claimed in claim 1, wherein said rear wheel rack further comprises two wheel axle bearings respectively fixedly fastened to said locating members and facing each other for supporting the wheel axle of the rear wheel of said bicycle.

17. The virtual reality bicycle-training simulation platform as claimed in claim 1, wherein said rear wheel rack further comprises a first axle holder and a second axle holder respectively mounted on said rear wheel supports at a top side in a transverse direction to hold said locating members on said rear wheel supports respectively.

18. The virtual reality bicycle-training simulation platform as claimed in claim 17, wherein said first axle holder is formed of a tubular nut; said second axle holder is formed of a barrel; said locating members include a first locating member formed of a screw bolt and threaded into said tubular nut of said first axle holder; and a second locating member supported in said barrel of said second axle holder.

19. The virtual reality bicycle-training simulation platform as claimed in claim 18, wherein said barrel of said second axle holder has an elongated slot; said second locating member is axially movably supported in said barrel of said second axle holder and locked thereto with a lock screw.

* * * * *